US008128435B2

(12) United States Patent
Trinh

(10) Patent No.: US 8,128,435 B2
(45) Date of Patent: Mar. 6, 2012

(54) ELECTRICAL INTERCONNECTING MODULE

(75) Inventor: Dat-Minh Trinh, Barntrup (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 130 days.

(21) Appl. No.: 12/595,018

(22) PCT Filed: Apr. 14, 2008

(86) PCT No.: PCT/EP2008/002930

§ 371 (c)(1),
(2), (4) Date: Oct. 7, 2009

(87) PCT Pub. No.: WO2008/125314

PCT Pub. Date: Oct. 23, 2008

(65) Prior Publication Data

US 2010/0120295 A1 May 13, 2010

(30) Foreign Application Priority Data

Apr. 12, 2007 (DE) ..... 10 2007 017 571

(51) Int. Cl.
*H01R 13/02* (2006.01)

(52) U.S. Cl. ..... 439/661; 439/814; 439/711

(58) Field of Classification Search ..... 439/661, 439/813, 814

See application file for complete search history.

(56) References Cited

U.S. PATENT DOCUMENTS 5,253,140 A * 10/1993 Inoue et al. ..... 361/728
5,641,313 A * 6/1997 Hohorst ..... 439/709
5,899,774 A * 5/1999 Sexton ..... 439/652
6,172,877 B1 1/2001 Feye-Hohmann et al.
6,359,770 B1 * 3/2002 Kolody et al. ..... 361/626
6,425,770 B1 * 7/2002 Lostoski et al. ..... 439/76.1
6,443,783 B1 * 9/2002 Beadle ..... 439/814
6,511,328 B2 * 1/2003 Molus et al. ..... 439/76.1
6,773,285 B2 * 8/2004 Bernat et al. ..... 439/246
6,848,951 B1 * 2/2005 Bechaz et al. ..... 439/716
7,351,093 B2 * 4/2008 Sakurai et al. ..... 439/422

(Continued)

FOREIGN PATENT DOCUMENTS

CH 681338 A5 2/1993

(Continued)

OTHER PUBLICATIONS

"Signal Converters—Interface 2005," Phoenix Contact Company, pp. 172 and 173.

(Continued)

*Primary Examiner* — Briggitte R Hammond
(74) *Attorney, Agent, or Firm* — Leydig, Voit & Mayer, Ltd.

(57) ABSTRACT

An electrical interface module including a connector configured for a data cable and a plurality of electrical contact elements configured to directly establish at least one of an electrical and an electronic connection with a plurality of corresponding mating contact elements of a terminal block. Each of the plurality of corresponding mating contacts includes a screw clamp terminal having a terminal compartment with a pressure element configured to clamp the respective contact element. Each of the plurality of electrical contact elements is configured to allow the at least one of the electrical and the electronic connection to be established via a connection with the respective pressure element when the respective screw clamp terminal is in an open position.

14 Claims, 7 Drawing Sheets

U.S. PATENT DOCUMENTS

| | | | | |
|---|---|---|---|---|
| 2001/0034165 | A1* | 10/2001 | Landis et al. | 439/716 |
| 2005/0112941 | A1* | 5/2005 | Droesbeke et al. | 439/579 |

FOREIGN PATENT DOCUMENTS

| | | | |
|---|---|---|---|
| DE | 1065502 | B | 9/1959 |
| DE | 4001025 | C1 | 5/1991 |
| DE | 29610415 | U1 | 8/1996 |
| DE | 29713960 | U1 | 12/1997 |
| DE | 102005027824 | A1 | 12/2006 |
| EP | 0813269 | A2 | 12/1997 |
| EP | 0896504 | A2 | 2/1999 |

OTHER PUBLICATIONS

"Signal Converters—Interface 2005," Phoenix Contact Company, pp. 182 and 183.

International Search Report, PCT/EP2008/002930, Sep. 8, 2008.

* cited by examiner

ELECTRICAL INTERCONNECTING MODULE

CROSS REFERENCE TO PRIOR APPLICATIONS

This application is a U.S. National Phase application under 35 U.S.C. §371 of International Application No. PCT/EP2008/002930, filed Apr. 14, 2008, and claims benefit to German Patent Application No. 10 2007 017 571.1, filed Apr. 12, 2007, both of which are incorporated by reference herein. The International Application was published in German on Oct. 23, 2008 as WO 2008/125314 under PCT Article 21(2).

FIELD

The present invention relates to an electrical interface module having a connector for a data cable and a plurality of electrical contact elements via which an electrical and/or electronic connection to a corresponding number of mating contact elements of a terminal block can be established.

BACKGROUND

Interface modules are described, for example, on pages 172 and 173 of the catalog "Signal Converters—INTERFACE 2005" of the Phoenix Contact company. The described interface modules have a connector for a data cable, said connector being electrically connected to contact elements in the form of screw-type terminals. Electrical and/or electronic connections can be established to mating contact elements of a terminal block via separate wires connected to said contact elements. The terminal block includes mating contact elements in the form of screw clamp terminals, and further preferably includes electronics for processing electrical and/or electronic signals received from the interface module.

This method of establishing electrical and/or electronic connections between the interface module and the terminal block is considered time-consuming and error-prone because each wire must be individually connected to its associated screw-type terminal on the interface module and, in addition, also to the corresponding screw clamp terminal on the terminal block.

This is remedied by the interface module described on pages 182 and 183 of the catalog "Signal Converters—INTERFACE 2005" of the Phoenix Contact company.

This interface module uses male contact elements in place of screw clamp terminals for electrical and/or electronic connection to a terminal block, said male contact elements being electrically connected to the connector for the data cable.

When used in combination with a specially designed terminal block, in which the mating contact elements take the form of screw clamp terminals and, in addition, are adapted in their design to the male contact elements, these male contact elements allow a direct electrical connection to be established in that all male contact elements of the interface module are simultaneously inserted into the correspondingly designed mating contact elements. This allows quick connection between the interface module and the terminal block.

SUMMARY

An aspect of the present invention is to provide an interface module which can be quickly electrically and/or electronically connected to a terminal block having screw clamp terminals. Another, alternative, aspect of the present invention provides a quick electrical and/or electronic connection between the interface module and the terminal block using screw clamp terminals as the mating contact elements, without having to make costly modifications to the terminal block for this purpose.

In an embodiment, the present invention provides an electrical interface module including a connector configured for a data cable and a plurality of electrical contact elements configured to directly establish at least one of an electrical and an electronic connection with a plurality of corresponding mating contact elements of a terminal block. Each of the plurality of corresponding mating contacts includes a screw clamp terminal having a terminal compartment with a pressure element configured to clamp the respective contact element. Each of the plurality of electrical contact elements is configured to allow the at least one of the electrical and the electronic connection to be established via a connection with the respective pressure element when the respective screw clamp terminal is in an open position.

BRIEF DESCRIPTION OF THE DRAWINGS

An exemplary embodiment of the present invention is shown in the drawings in a purely schematic way and will be described in more detail below. In the drawings.

DETAILED DESCRIPTION

Figure 1:
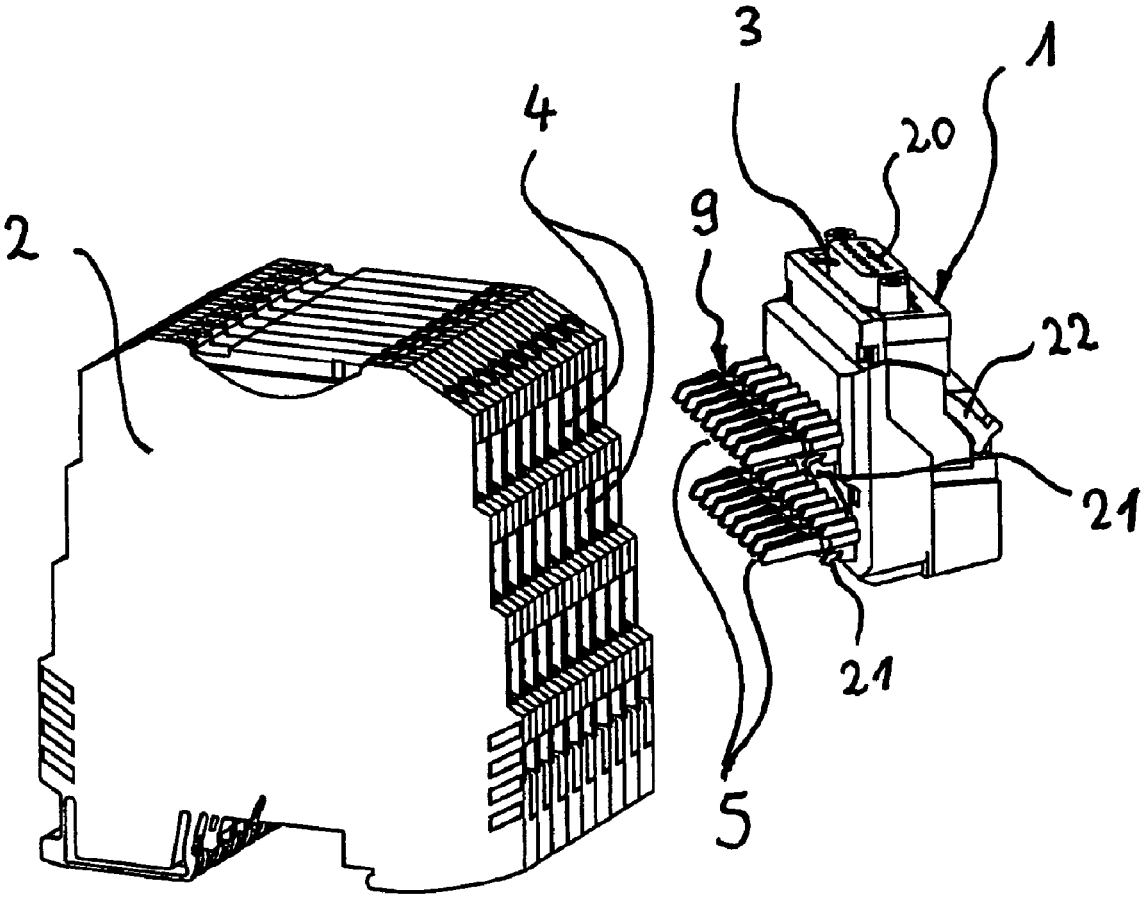
FIG. 1 is a perspective view showing a terminal block and a detached interface module having a connector for a data cable in accordance with an embodiment of the present invention.

The electrical contact elements of the interface module of the present invention are designed to allow an electrical and/or electronic connection to be established via the same directly to the mating contact elements on the terminal block, which are in the form of screw clamp terminals. The screw clamp terminals of the present invention each have one terminal compartment containing a pressure piece for clamping the contact element of the interface module; it being possible for the electrical and/or electronic connection via the electrical contact elements to be established when the screw clamp terminals are open, and the contact elements being configured to allow the electrical and/or electronic connection to the pressure piece to be established by way of the same.

This adaptation of the design of the interface module's electrical contact elements to the screw clamp terminals allows an electrical and/or electronic connection to be quickly and easily established between the interface module and a terminal block that has screw clamp terminals. This is possible without any modifications to the terminal block because the contacts of the interface module can be connected to the screw clamp terminals directly. Therefore, no electrical wires are needed for the electrical and/or electronic connection to the screw clamp terminal block. The adapted design of the contact elements of the interface module makes the interface module universally usable. This allows it to be used with any terminal block that has screw clamp terminals, independently of whether or not an additional connection option, for example via bridge channels, is provided. Since the individual contact elements of the interface module are designed to allow the electrical and/or electronic connection via the electrical contact elements to be established when the screw clamp terminals are open, there is no need to screw in the screw in order to clamp the contact to be connected.

In an advantageous embodiment of the present invention, the electrical contact elements are each configured with at least one flat planar portion which abuts a flat portion of an electrically conductive part of the associated screw clamp terminal during the electrical and/or electronic connection. This adaptation of the contact element's geometry to that of the conductive part ensures that the contact resistance is low.

To ensure a permanent electrical and/or electronic connection between the contact elements and the screw clamp terminals, the contact elements are configured to be resilient such that they each press against the respective electrically conductive parts of the screw clamp terminals during the electrical and/or electronic connection.

Reliable contact is also ensured by a latched connection between the interface module and the terminal block. In this manner, a conventional screw clamp terminal turns into a plug-in base strip, thus providing a direct plug-in system. This allows both a quick and reliable electrical and/or electronic connection and a reliable mechanical connection to be established between the interface module and the terminal block.

In order to obtain a stable form-fitting connection between the contact element and the screw clamp terminal, the contact elements are at least partially accommodated within a U-shaped receiving chamber and at least partially surrounded and protected by the walls thereof.

When establishing the electrical and/or electronic connection, the contact elements are preferably inserted into the terminal compartments of the screw clamp terminals along with their respective receiving chambers. This makes it possible to use slender contact elements without risk of them becoming deformed during insertion into the terminal compartment.

In an advantageous embodiment of the present invention, the contact elements include a metal strip bent in the shape of a wedge and having a first leg and a second leg, the contact elements being configured such that when the electrical and/or electronic connection is established between the contact elements and the mating contact elements, the first leg of the metal strip presses resiliently against an electrically conductive part of the screw clamp terminal. This metal strip is mechanically rugged and easy to manufacture in a folding process.

In order for the contact element in the form of the metal strip to provide the necessary pressure against the electrically conductive part of the screw clamp terminal, a third leg is formed integrally with the first leg in such a way that it limits the deflection of the first leg. The deflection can be limited in a simple manner, for example by configuring the third leg to face away from the first leg toward the second leg. In this manner, it is achieved that the first leg, via the third leg, on the second leg corresponding pressure, is supported on the first leg toward the second leg.

Thus, the wedge-shaped metal strip stiffens when pressed into the terminal compartment of a screw clamp terminal.

The limitation of the deflection causes the resilient wedge shape to stiffen, thereby providing the necessary contact pressure against the metallic pressure piece.

According to an advantageous embodiment, the housing of the interface module is provided with hooks for latching engagement with the terminal block, it being possible to operate said hooks using a release and/or ejection mechanism in the form of an operating lever provided on the housing.

Figure 2:
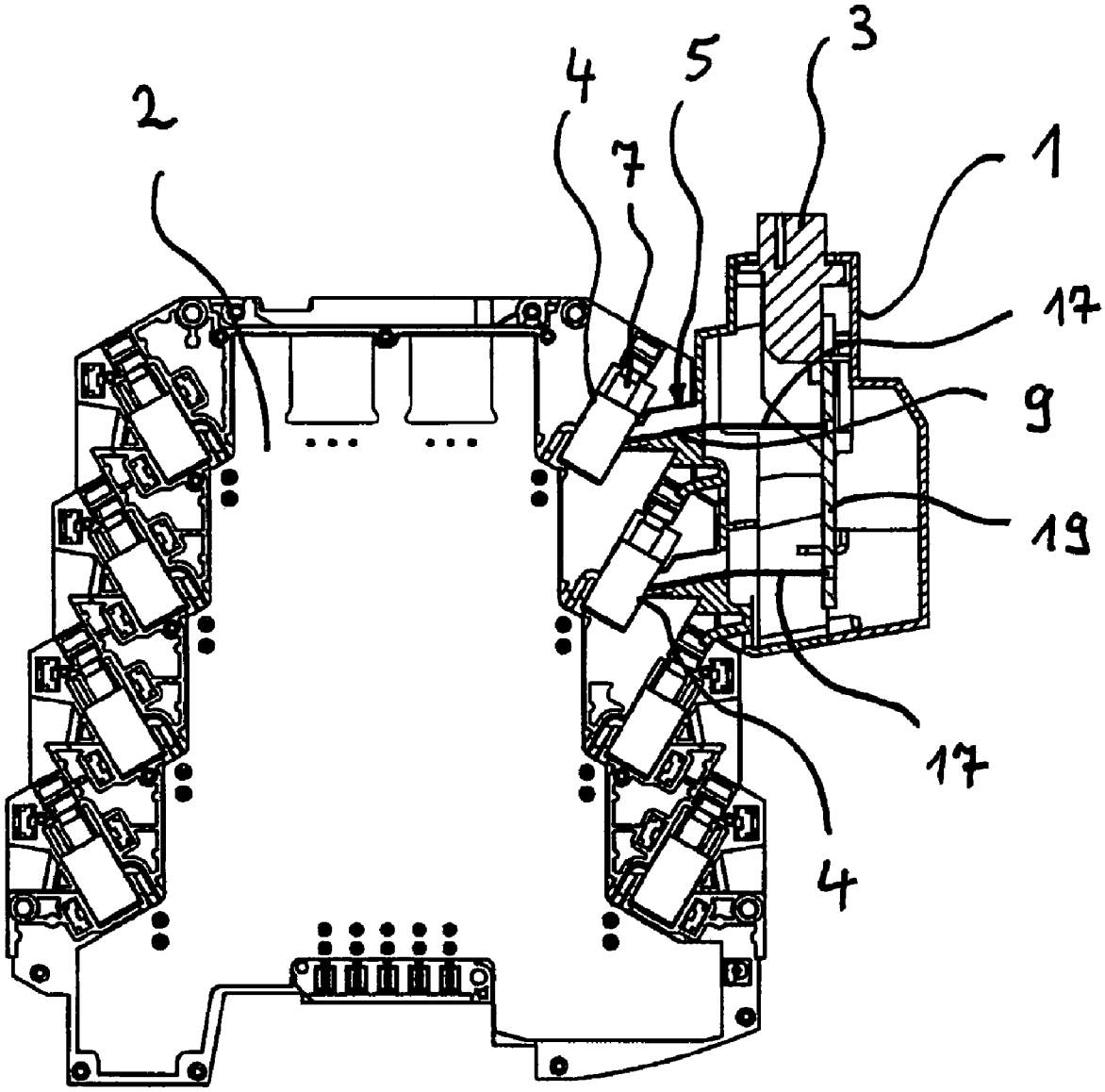
FIG. 2 is a cross-sectional side view showing the terminal block with the interface module attached thereto in accordance with an embodiment of the present invention.
Figure 3:
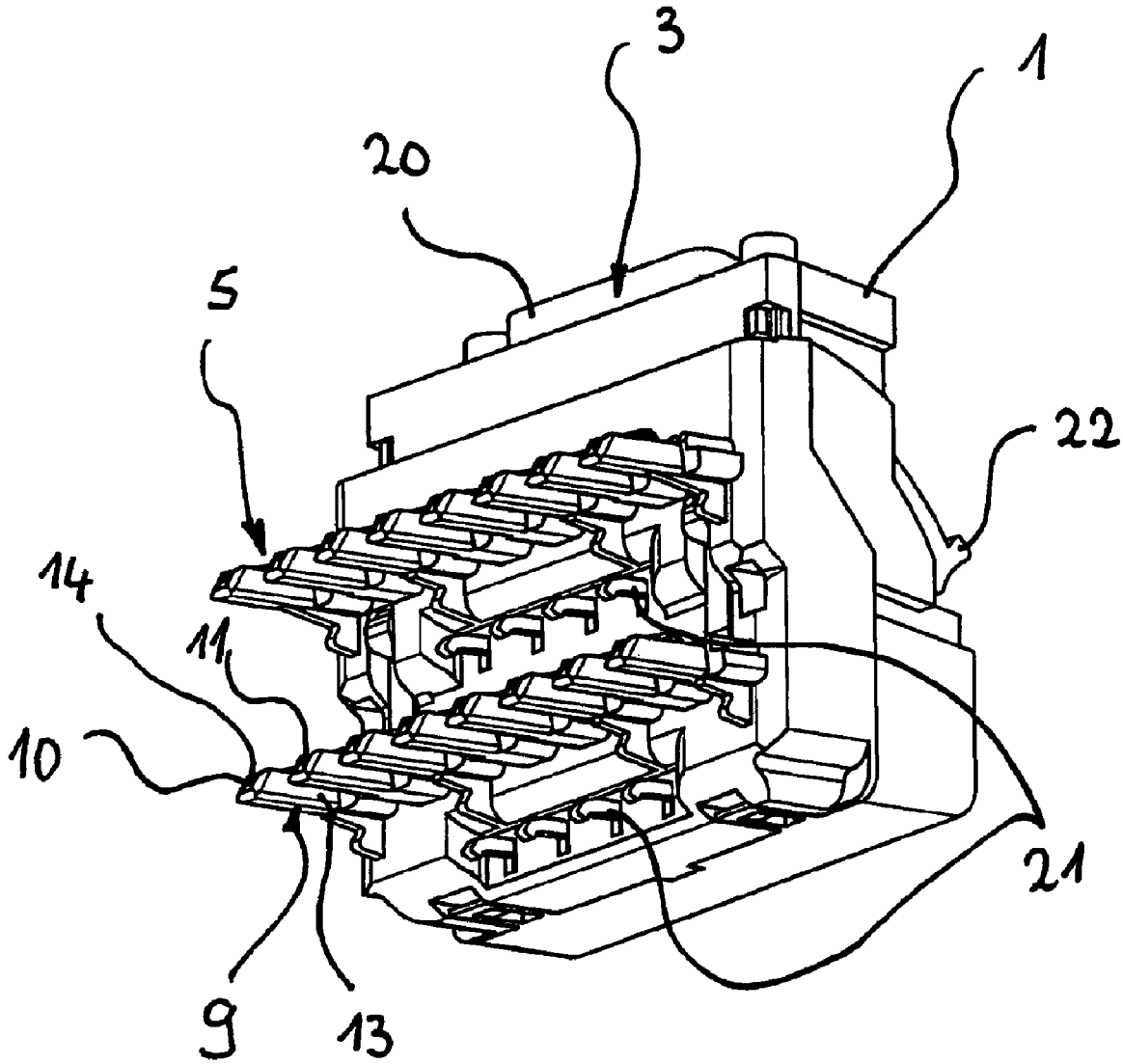
FIG. 3 is a perspective view of the interface module, looking at the contact elements thereof in accordance with an embodiment of the present invention.

FIGS. 1 and 2 show an interface module 1 having a connector which has a row of contacts for a data cable (not shown). Interface module 1 has a plurality of electrical contact elements 5 via which an electrical and/or electronic connection to a corresponding number of mating contact elements of a terminal block 2 can be established, said mating contact elements taking the form of screw clamp terminals 4.

Each screw clamp terminal 4 has one terminal compartment 8 associated therewith, said terminal compartment having a pressure piece 6 for clamping a contact element 5.

Contact elements 5 of interface module 1 are arranged in two rows, one above the other, and are perpendicular to connector 20 for the data cable.

As can be seen in the cross-sectional view of FIG. 2, when the electrical and/or electronic connection is established, contact elements 5 of interface module 1 are inserted in screw clamp terminals 4 of terminal block 2.

Figure 4:
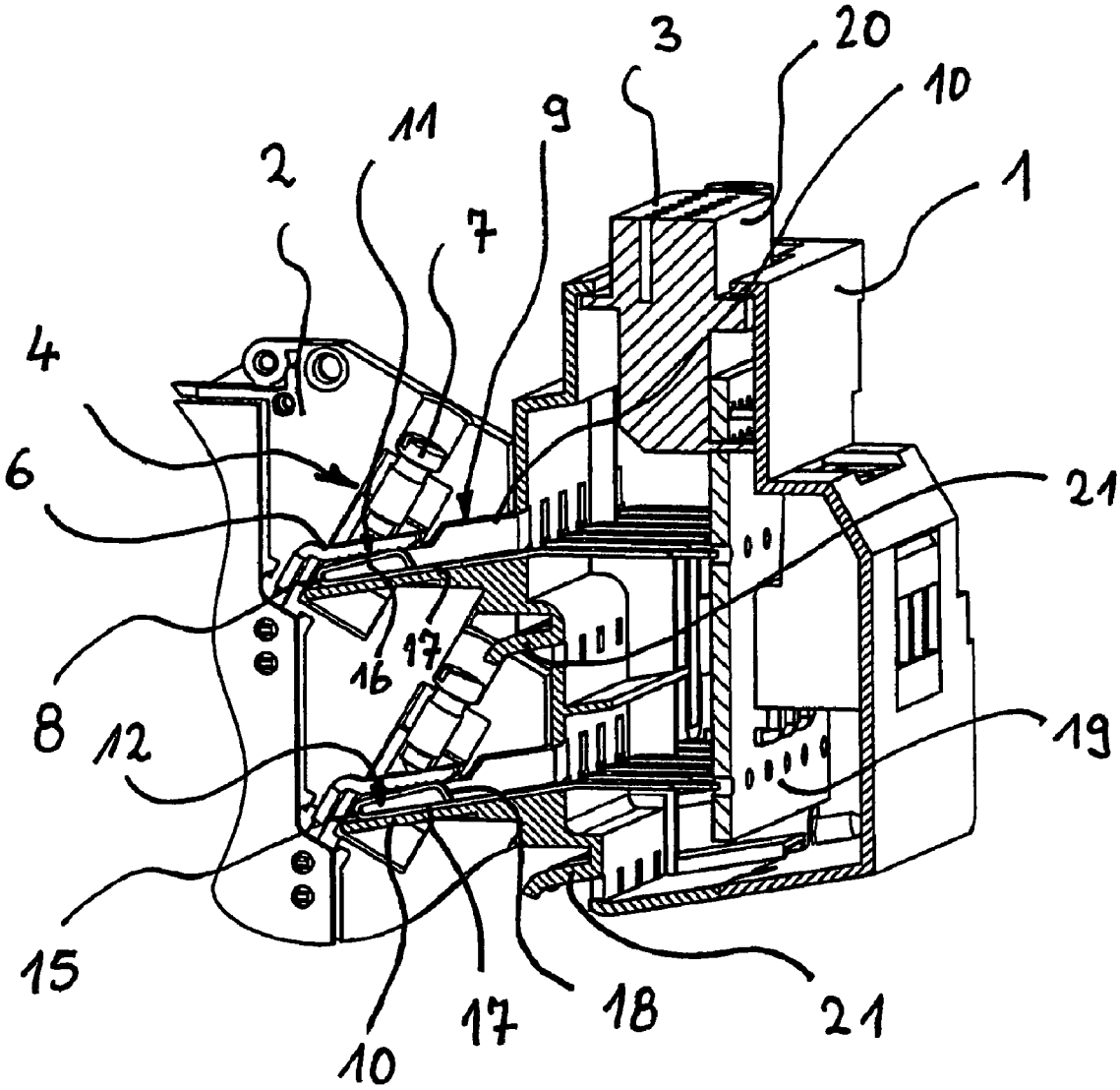
FIG. 4 is a cross-sectional view showing the interface module in a position in which its contact elements engage into the screw clamp terminals of a terminal block in accordance with an embodiment of the present invention.
Figure 5:
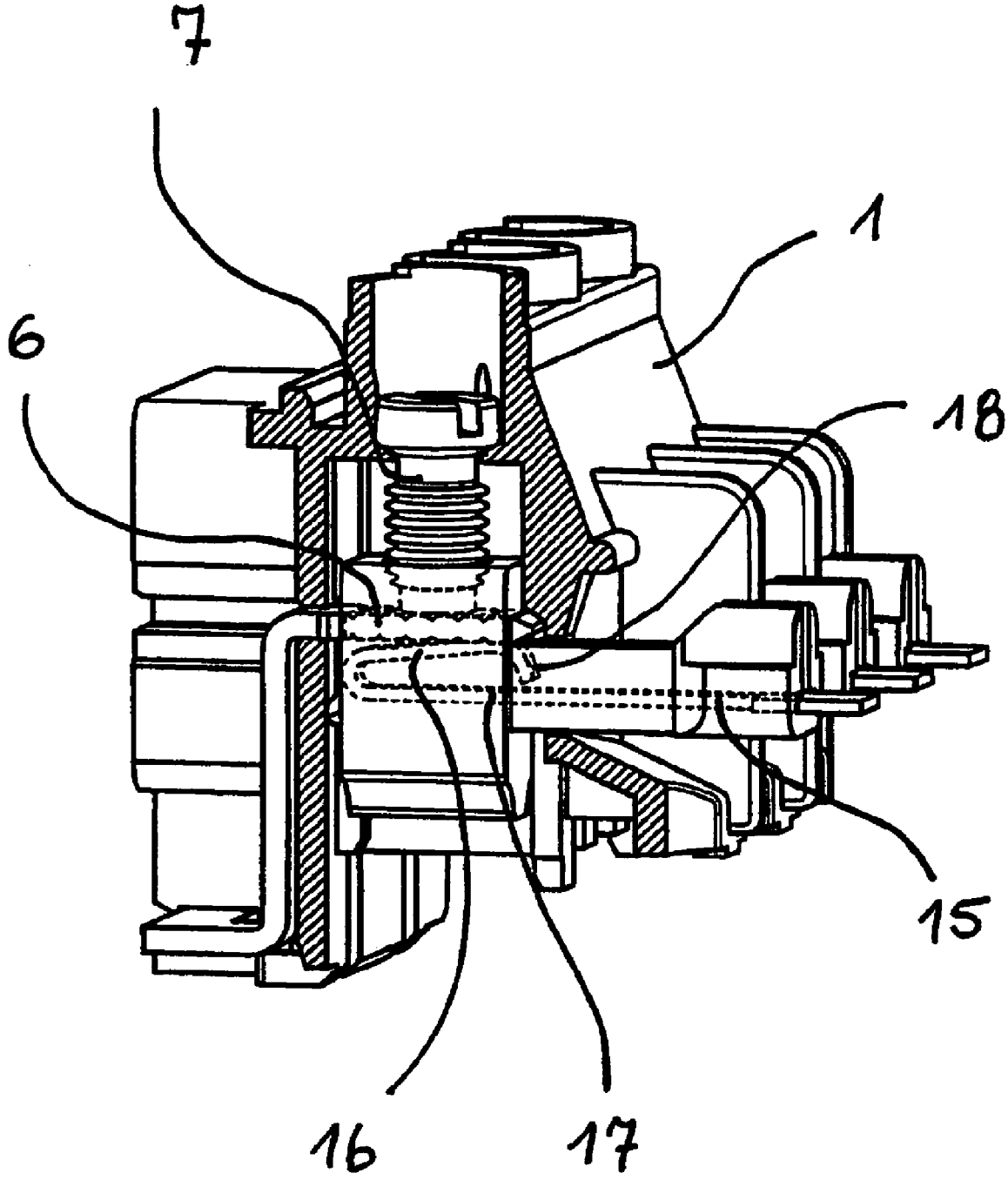
FIG. 5 is a view of another embodiment of the present invention, also with the region of attachment of an interface module shown in a cross-sectional view.
Figure 6:
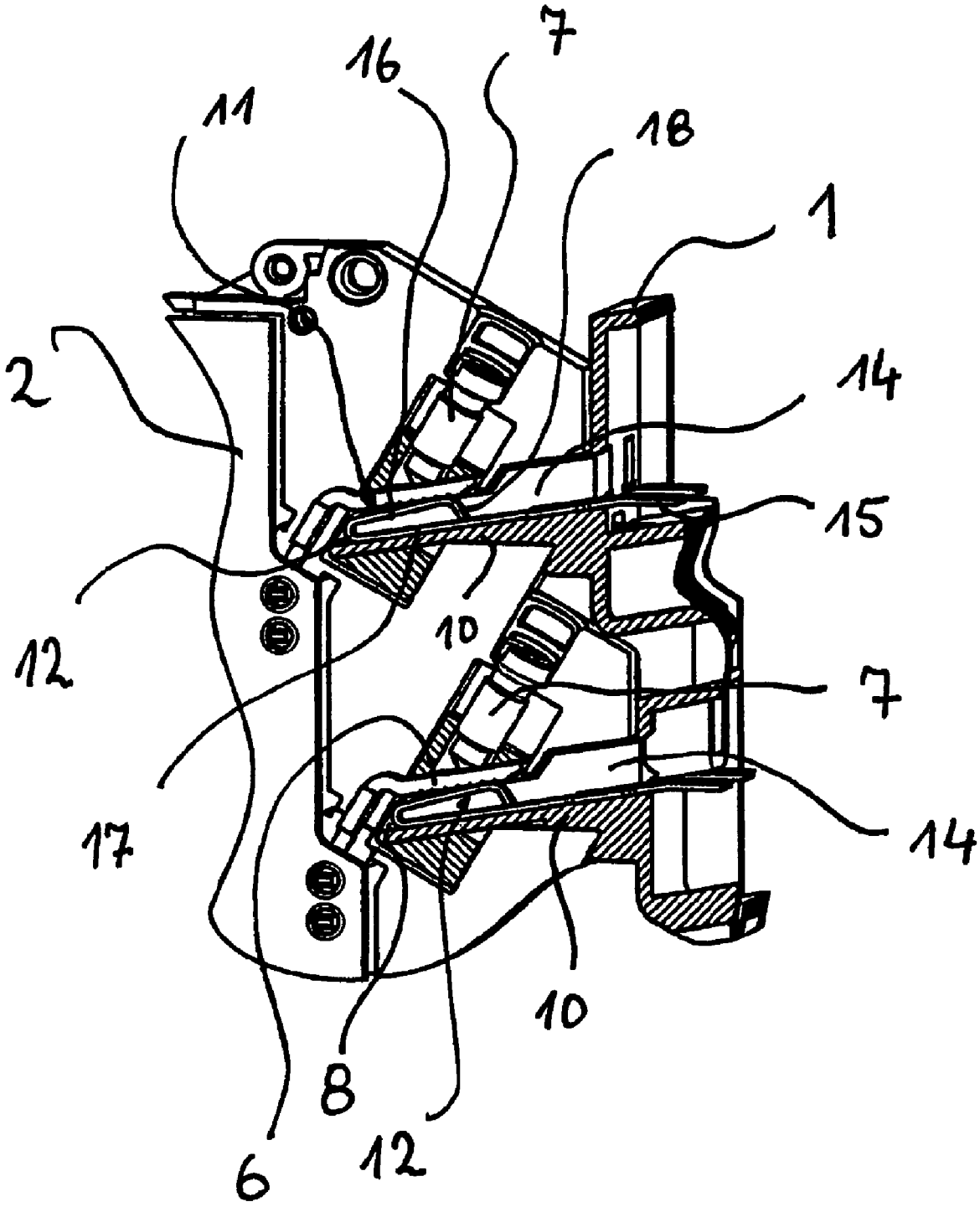
FIG. 6 is a further view showing a detail of FIG. 4.

As can be seen in FIGS. 4, 5 and 6, each individual screw clamp terminal 4 includes a terminal compartment 8 having a clamping screw 7 and a pressure piece 6 made of an electrically conductive material.

According to an embodiment of the present invention, electrical contract elements 5 of interface module 1 are designed to allow an electrical and/or electronic connection to be established via the same directly to the mating contact elements on terminal block 2, which are in the form of screw clamp terminals 4. This design of contact elements 5 eliminates the need to operate clamping screw 7 in order for contact elements 5 to be clamped within terminal compartment 7 by pressure piece 6. Preferably, the electrical and/or electronic connection via electrical contact elements 5 can be established when screw clamp terminals 4 are open. Male contact elements are particularly suited as the contact elements 5.

In this case, in order to facilitate mechanical connection of contact element 5, contact elements 5 are at least partially accommodated within a U-shaped receiving chamber 10 and at least partially surrounded and protected by the walls 13, 14 thereof.

Contact elements 5 each extend at least partly within a U-shaped receiving chamber 10, the contact elements 5 being inserted into screw clamp terminals 4 along with their respective receiving chambers 10 as the electrical and/or electronic connection is established.

In the inserted position, U-shaped receiving chamber 10 is in form-fitting contact with the walls of terminal compartment 8. In this manner, a guided, jam-free and reliable mechanical plug-in connection is achieved. Receiving chamber 10 is slightly tapered toward its free end, as is also illustrated in FIG. 4. A particular advantage provided by this taper is that contact element 5 has sufficient clearance within terminal compartment 8 to freely move into contact with the pressure piece 6 located in the upper region, and more specifically here with the underside thereof, to establish the electrical connection.

Contact element 5 is configured to be resilient, in at least a portion thereof, to facilitate the establishment of the electrical connection. Because of this, contact element 5 is automatically moved into contact with electrically conductive pressure piece 6 as the electrical and/or electronic connection is established. As can be seen from FIGS. 4, 5 and 6, resilient contact element 5 is formed of an elongated strip of metal 12 and extends within U-shaped receiving chamber 10 between walls 13, 14 thereof. Metal strip 12 is wedge-shaped in cross-section. It has a first leg 16 and a second leg 17, and is configured such that when establishing the electrical and/or electronic connection between metal strip 12, which serves as a contact element 5, and the mating contact element, first leg 16 of metal strip 12 presses resiliently against an electrically conductive part, such as pressure piece 6, of screw clamp terminal 4.

As can be seen in FIGS. 4 and 5, and also in FIG. 6, a third leg 18 is formed integrally with the end of first leg 16. The third leg faces toward the second leg 17 and braces leg 16 against second leg 17. Consequently, third leg 18 limits the deflection of first leg 16 in a direction toward second leg 17. Thus, wedge-shaped metal strip 12, which acts as a contact element 5, is stiffened during insertion into terminal compartment 8 once third leg 18 abuts second leg 17. As a result, sufficient pressure is exerted against pressure piece 6, and more specifically here against the underside thereof, while clamping screw 7 is in an untightened position, causing interface module 1 to be electrically and self-retainingly connected to terminal block 2. This is further assisted, for example, by corrugations formed on the underside of pressure piece 6 so as to prevent interface module 1 from accidentally and unintentionally falling out.

As can also be seen from FIG. 4, second legs 17 of metal strips 12 are inserted in the housing of interface module 1 in such a manner that they are connected and wired to connector 20 via a circuit board 19 mounted within the housing.

Figure 7:
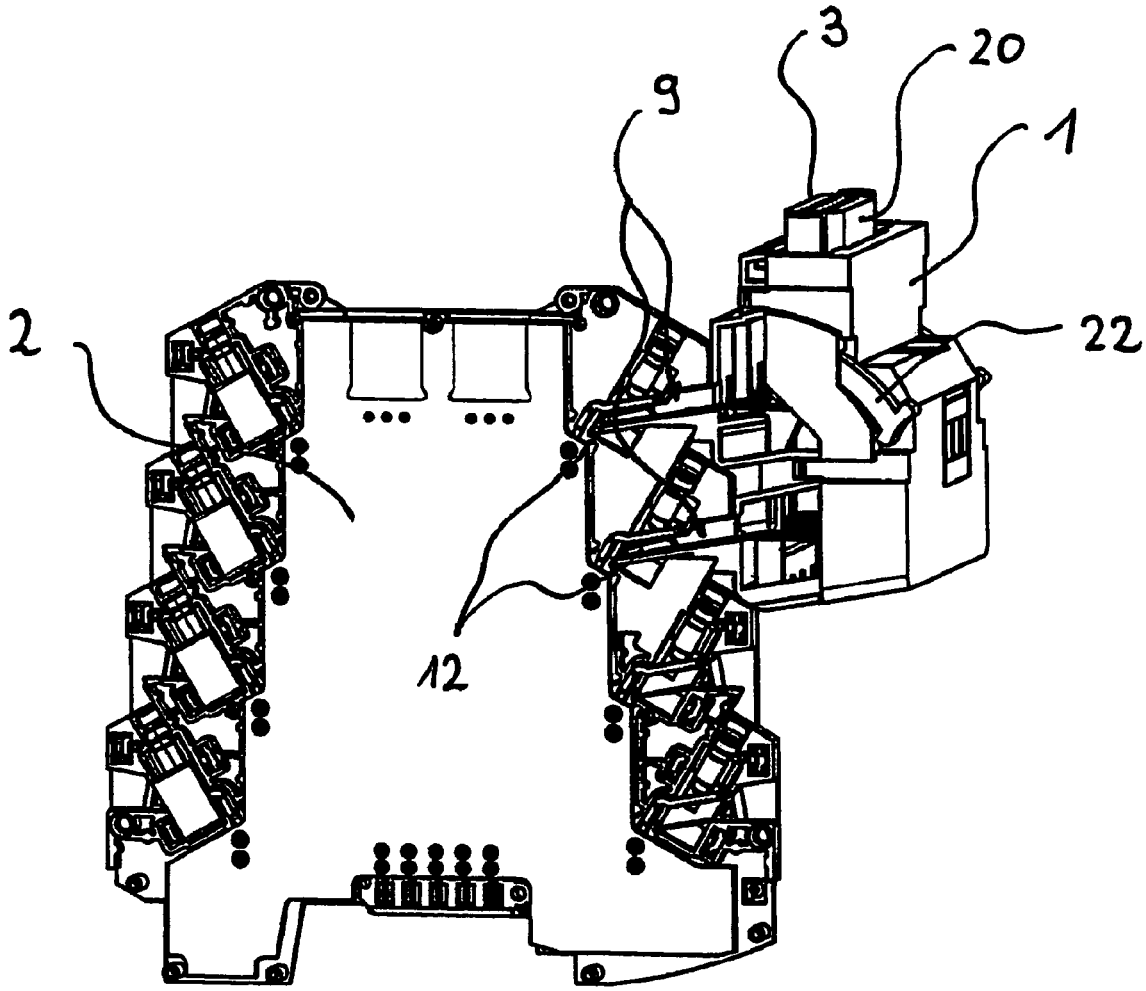
FIG. 7 is another, different view of an attached interface module according to FIG. 2.

In another embodiment of the present invention, illustrated in FIGS. 1, 2 and 7, the housing of interface module 1 is provided with hooks 21 for latching interface module 1 to terminal block 2. This latched connection provides a way to hold interface module 1 to terminal block 2. In this connection, hooks 21 cooperate with a release and/or ejection mechanism. The release and/or ejection mechanism can be operated from outside the housing, for example via a lever 22, allowing interface module 1 to be detached from terminal block 2.

While the invention has been particularly shown and described with reference to preferred embodiments thereof, it will be understood by those skilled in the art that various changes in form and details may be made therein without departing from the spirit and scope of the invention.

LIST OF REFERENCE NUMERALS

1 interface module
2 terminal block
4 screw clamp terminals
5 contact elements
6 pressure piece
7 clamping screw
8 terminal compartment
9 clamping sleeve
10 receiving chamber
12 metal strip
13 leg walls
14 leg walls
16 first leg
17 second leg
18 third leg
19 circuit board
20 connector
21 hook
22 lever
22 cover

What is claimed is:

1. An electrical interface module, comprising:

a connector configured for a data cable; and a plurality of electrical contact elements configured to directly establish at least one of an electrical and an electronic connection with a plurality of corresponding mating contact elements of a terminal block, each of the plurality of corresponding mating contacts including a screw clamp terminal having a terminal compartment with a pressure element configured to clamp the respective contact element, wherein each of the plurality of electrical contact elements is configured to be inserted and clamped in a respective screw clamp terminal via a connection with the respective pressure element when the respective screw clamp terminal is in an open position so as to establish the at least one of electrical and electronic connection.

2. The electrical interface module as recited in claim 1, wherein each of the plurality of electrical contact elements includes at least one flat planar portion abutting a respective electrically conductive flat portion of the respective screw clamp terminal in establishing the at least one of the electrical and the electronic connection.

3. The electrical interface module as recited in claim 1, wherein the plurality of electrical contact elements include male contact elements.

4. The electrical interface module as recited in claim 1, wherein the plurality of electrical contact elements are resilient so as to press against an electrically conductive portion of the screw clamp terminal when the at least one of the electrical and the electronic electrical connection is established.

5. The electrical interface module as recited in claim 1, wherein the plurality of electrical contact elements include a wedge-shaped metal strip having a first leg and a second leg, each first leg extending from a respective second leg at an insertion end of the respective contact element and being configured so as to resiliently press against an electrically conductive portion of the respective screw clamp terminal when the at least one of the electrical and the electronic connection is established.

6. The electrical interface module as recited in claim 5, wherein a third leg is integrally formed with the first leg so as to limit a deflection of the first leg.

7. The electrical interface module as recited in claim 6, wherein the third leg is disposed extending away from the first leg toward the second leg.

8. The electrical interface module as recited in claim 1, further comprising a fastening element configured to mechanically couple the electrical interface module to the terminal block.

9. The electrical interface module as recited in claim 1, wherein the plurality of electrical contact elements are at least partially disposed within a U-shaped receiving chamber so as to be at least partially surrounded and protected by walls of the receiving chamber.

10. An electrical interface module, comprising:

a connector configured for a data cable; and a plurality of electrical contact elements configured to directly establish at least one of an electrical and an electronic connection with a plurality of corresponding mating contact elements of a terminal block, each of the plurality of corresponding mating contacts including a screw clamp terminal, wherein each of the plurality of electrical contact elements is configured to be inserted and clamped in a respective screw clamp terminal when the respective screw clamp terminal is in an open position so as to establish the at least one of the electrical and the electronic connection.

11. The electrical interface module as recited in claim 10, wherein each of the plurality of electrical contact elements extends at least partially within a U-shaped receiving chamber, each U-shaped receiving chamber being configured to be inserted into each respective screw clamp terminal along with the respective electrical contact element when the at least one of the electrical and the electronic connection is established.

12. The electrical interface module as recited in claim 10, the electrical interface module further comprising a housing having hooks configured to engage with the terminal block.

13. The electrical interface module as recited in claim 12, wherein the hooks cooperate with a release mechanism disposed on the interface module.

14. An electrical connector, comprising:

an electrical interface module; and a terminal block having a plurality of mating contact elements each including a screw clamp terminal, the electrical interface module including:

a connector configured for a data cable; and a plurality of electrical contact elements configured to directly establish at least one of an electrical and an electronic connection with each of the plurality of mating contact elements of the terminal block, each of the plurality of electrical contact elements being inserted and clamped in a respective screw clamp terminal so as to establish the at least one of the electrical and the electronic connection when the respective screw clamp terminal is in an open position.

* * * * *